US006430883B1

(12) United States Patent
Paz et al.

(10) Patent No.: US 6,430,883 B1
(45) Date of Patent: Aug. 13, 2002

(54) WALL SYSTEM

(75) Inventors: Felix Paz, Farmingdale; Edward Owsinksi, Kings Park, both of NY (US)

(73) Assignee: Paz Systems, Inc., Farmingdale, NY (US)

( * ) Notice: Subject to any disclaimer, the term of this patent is extended or adjusted under 35 U.S.C. 154(b) by 0 days.

(21) Appl. No.: 09/633,462

(22) Filed: Aug. 8, 2000

(51) Int. Cl.[7] ..... E04F 13/00

(52) U.S. Cl. ..... 52/235; 52/27; 52/243; 52/387; 52/762; 52/778; 52/779

(58) Field of Search ..... 52/235, 387, 506.06, 52/506.08, 506.09, 506.01, 775, 27, 238.1, 243, 489.1, 762, 763, 778, 779, 239

(56) References Cited

U.S. PATENT DOCUMENTS

| | | | | | |
|---|---|---|---|---|---|
| 1,982,560 | A | * | 11/1934 | Williams | 52/387 |
| 3,387,422 | A | * | 6/1968 | Wanzer | 52/387 |
| 3,412,515 | A | * | 11/1968 | Finon | 52/480 |
| 3,719,014 | A | * | 3/1973 | Sukolics | 52/235 |
| 3,888,055 | A | * | 6/1975 | Gallo | 52/98 |
| 4,107,887 | A | * | 8/1978 | Wendt | 52/105 |
| 4,370,838 | A | * | 2/1983 | Vermillion | 52/36.1 |
| 4,422,275 | A | * | 12/1983 | Baetje | 52/509 |
| 4,506,484 | A | * | 3/1985 | Bartlett et al. | 52/476 |
| 4,516,373 | A | * | 5/1985 | Osawa | 52/387 |
| 4,660,339 | A | * | 4/1987 | Paz | 52/238.1 |
| 4,765,111 | A | * | 8/1988 | Osawa | 52/509 |
| 5,216,859 | A | * | 6/1993 | Moreno et al. | 52/238.1 |
| 6,170,214 | B1 | * | 1/2001 | Treister et al. | 52/511 |
| 6,289,646 | B1 | * | 9/2001 | Watanabe | 52/506.01 |

* cited by examiner

*Primary Examiner*—Beth A. Stephan
*Assistant Examiner*—Brian E. Glessner
(74) *Attorney, Agent, or Firm*—Ostrolenk, Faber, Gerb & Soffen, LLP

(57) ABSTRACT

A wall system includes a grid constructed of horizontal main support channels mounted on a fixed wall and a plurality of spaced vertical standards secured to the channels at the front thereof. Each channel has a U-shaped cross-section with rearwardly extending arms diverging slightly so that overlapping channels may nest, one in the other. Ears projecting outward from the ends of the arms and lie in a common plane are used for securing the channel in place. The web of each channel is provided with a longitudinally extending row of equally spaced apertures. Each standard is provided with two longitudinally extending rows of holes with the rows being spaced by the distance between apertures and the holes in opposite rows being connected by lines that are perpendicular to the longitudinal axis of the standard. Fasteners extending through holes in each row are received by adjacent apertures in the channel web to automatically secure the standard in a position at right angles to the support channel.

17 Claims, 7 Drawing Sheets

FIG. 9A.
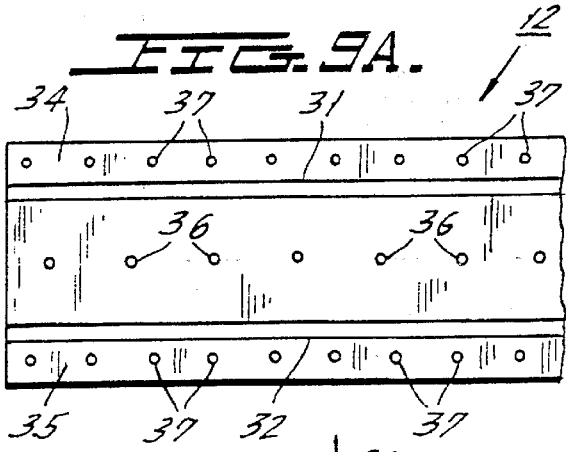
FIG. 9.
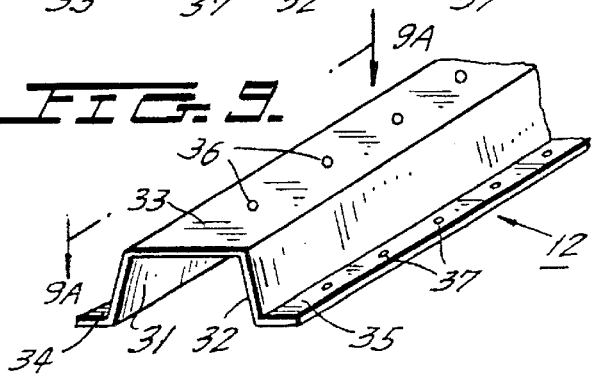
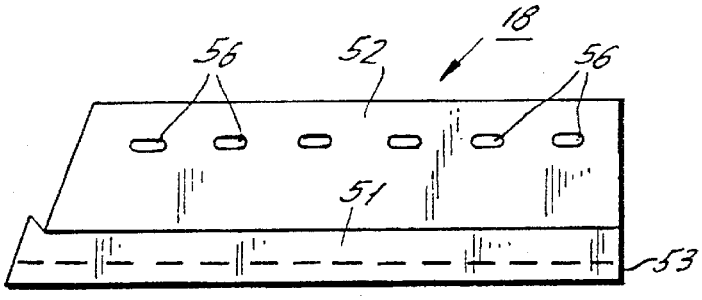
FIG. 8A.
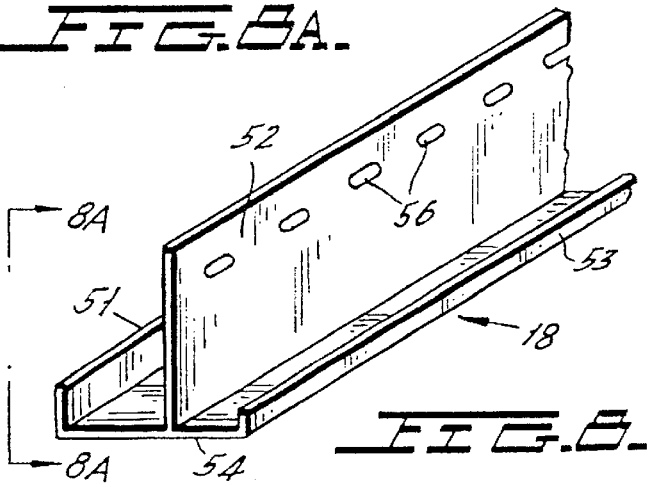
FIG. 8.
FIG. 3.
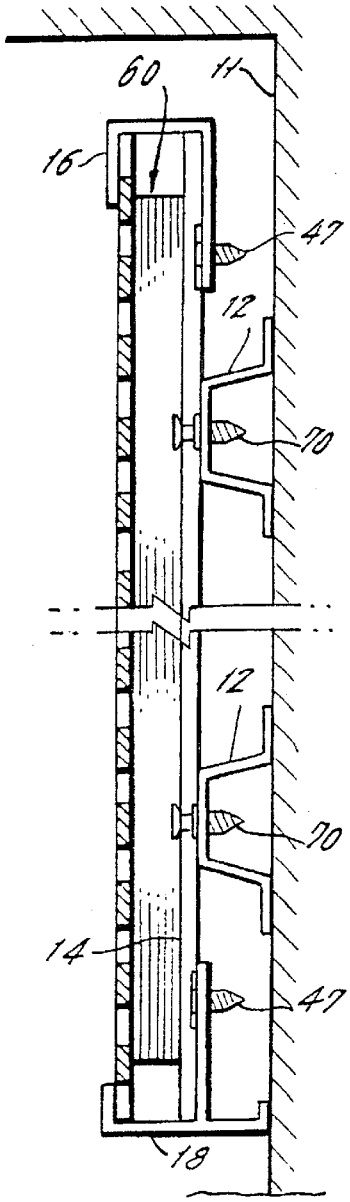

WALL SYSTEM

BACKGROUND OF THE INVENTION

1. Field of the Invention

This invention relates to wall systems in general and more particularly relates to wall systems having readily removable and replaceable panels and display elements.

2. Description of the Related Prior Art

In restaurants, offices, retail stores and merchandise showrooms, the trend is to make major changes in wall surfacing and/or displays during the course of the year because of seasonal changes or to prominently display particular products. This has given rise to so-called wall systems having provisions for removable and replaceable panels and provisions for selectively mounting projecting support arms. Typical prior art wall systems are disclosed in U.S. Pat. No. 3,719,014 issued Mar. 6, 1973 to R. D. Sukolics for a "Wall System," U.S. Pat. No. 4,370,838 issued Feb. 1, 1983 to E. F. Vermillion for a "Curtain Wall" and U.S. Pat. No. 4,660,339 issued Apr. 28 1987 to Felix Paz for a "Wall System," this last patent being hereby incorporated by reference.

With prior art wall systems, installation usually required the services of skilled mechanics. This was especially true when the wall system was attached to a wavy wall or a badly out-of-plumb wall. Several prior art systems require double head screws, glue strips and adhesive to attach wall panels and permit their subsequent removal. Even in those instances where installation of prior art wall systems was relatively simple, the attendant systems generally lacked versatility and adaptability. That is, prior art wall systems permitted display alterations only with great effort, and often they did not have sawtooth or wing sections and/or did not provide a finished look. Often, a wall section would have to be constructed a section at a time, with panels and supports built together rather than independently.

SUMMARY OF THE INVENTION

Accordingly, a primary object of the instant invention is to provide a novel, flexible and readily adaptable wall system constructed of relatively inexpensive components.

Another object is to provide a wall system of this type that is relatively simple to install.

Still another object is to provide a wall system of this type that may be installed by a relatively unskilled mechanic.

A further object is to provide a wall system of this type that is adapted to mount panels of different thicknesses of various materials, and utilizes blind fastening means to releasably mount such panels.

A still further object of the present invention is to provide a wall system where panels and supports can be installed independent of each other.

In accordance with the instant invention, a main grid is constructed that consists of horizontal support channels that are secured directly to a wall and vertical standards that are secured to the fronts of the channels. The horizontal support channels are of generally U-shaped cross-section and have outwardly flaring ears at the rear thereof, while the standards are connected to the web at the front of the channel. Each web is provided with equally spaced apertures disposed at a longitudinal row. In one embodiment of this invention each standard is provided with holes that are equally spaced and are disposed in two vertical rows. These rows are spaced apart by the distance between adjacent apertures in the web of the channel so that by securing a standard to a channel, these elements automatically cross at right angles.

In constructing the grid, the first support channel that is mounted to the wall must be straight and horizontal and its web must lie in a vertical plane. Thereafter, standards are secured to the web of the first channel and as the former are secured they are automatically located in a single vertical plane. Additional channels are then slipped behind the standards and are secured thereto so as to be parallel to the first channel. This assures that all of the channels lie in a single plane. Spaces between these additional channels and the supporting wall are taken up by shims that are located at points where these channels are attached to the wall, and then these channels are secured to the supporting wall.

The arms of the main channel diverge slightly in the direction away from the connecting web. This permits nesting of one channel member with another channel member to facilitate the construction of auxiliary wall sections such as a wing or sawtooth. That is, to construct an auxiliary wall section, the arms of a channel section are notched at predetermined locations to permit bending of the channel section web at locations defined by the notches. The channel is bent into a mounting section and a panel supporting section which are at a predetermined angle with respect to each other. The mounting section is telescoped over one of the main channel sections that is secured to the mounting wall and the supporting section is positioned at a predetermined angle with respect to this main channel. One or more additional supporting sections are formed in the channel member having the original supporting section and finally another mounting section is formed at the end of this channel member remote from the other mounting section. When necessary, cross-bracing is provided between one or more of the mounting sections and the main channel section that is secured to the wall.

Spaced main vertical members, or standards, are vertically aligned, right-angle channel sections aligned side-by-side to form an inverted T shape. The portions of these right-angle channels that form the trunk of the T shape are spaced apart and attached with recessed ribs at intervals along the length of their aligned surfaces. The standards are secured to the channel members to form a grid for supporting the wall panel sections.

Each standard has a number of spaced apart channel tabs at intervals along the length of the channels, extending in a direction parallel with the top of the inverted T. The channel tabs are shaped to cooperate with a wall panel section to permit the wall panel section to be inserted between, and supported by, two standards. The wall panel sections have panel tabs undercut by a slot in a side surface which is slightly larger than a thickness of the channel tabs. Notches are formed in the rear surface of the wall panel near an edge with an undercut slot so that the undercut slot is accessible from the rear surface through the notches. The notches define tabs on a corner of the wall panel common to the rear and side surfaces of the wall panel. When the wall panel section is inserted between two standard sections, the tabs on the wall panel and on the standard sections are interlaced, with the wall panel tabs fitting between the intervals of the standard tabs, and vice-versa. Once the wall panel section is inserted between the two standard sections, it is slid downward to interlock the standard tabs with the wall panel section tabs. The standard tabs slide along the undercut slot in the panel to be positioned behind the wall panel section tabs. Once the standard tabs are in a position adjoining the wall panel section tabs, the panel is interlocked with the standard sections. The interlocking sets of tabs secure the wall panel section and the standards in an arrangement where the wall panel sections can be easily removed.

The above, and other objects, features and advantages of the present invention will become apparent from the following description read in conjunction with the accompanying drawings, in which like reference numerals designate the same elements.

BRIEF DESCRIPTION OF THE DRAWINGS

The above objects as well as other objects and advantages of this invention shall become readily apparent after reading the following description of the accompanying drawings in which:

FIG. 3 is a cross-section taken through line 3—3 of FIG. 1 looking in the direction of arrows 3—3.

FIG. 8 is a fragmentary perspective of a bottom channel.

FIG. 8A is a front elevation of the bottom channel of FIG. 8 looking in the direction of arrows 8A—8A.

FIG. 9 is a fragmentary perspective of a main support channel.

FIG. 9A is a front elevation of the main support channel of FIG. 9 looking in the direction of arrows 9A—9A.

DETAILED DESCRIPTION OF THE PREFERRED EMBODIMENTS

Figure 1:
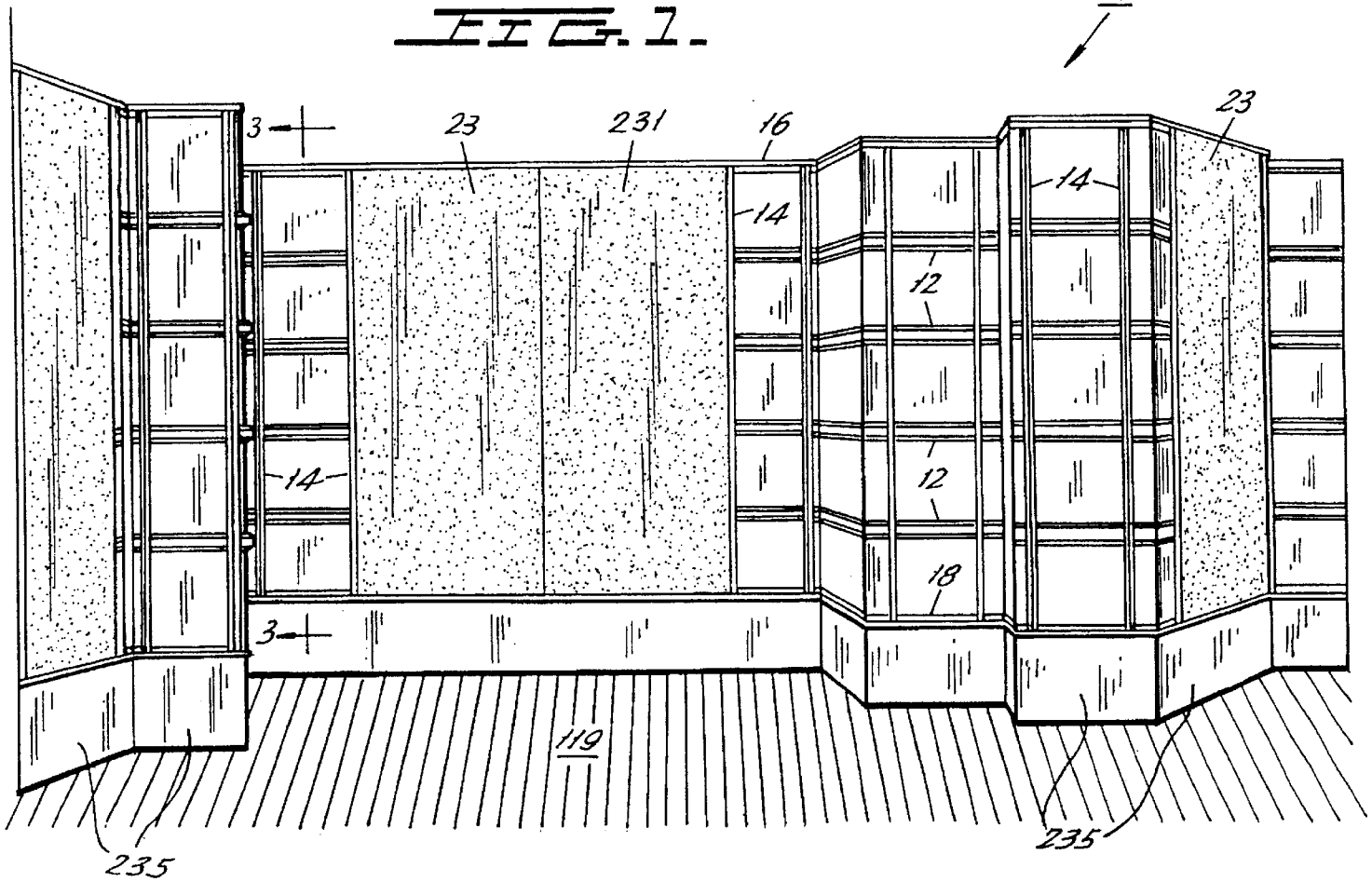
FIG. 1 is a perspective looking at the front of a wall system constructed in accordance with teachings of the instant invention, with some wall panels removed to illustrate the supporting grid work.
Figure 2:
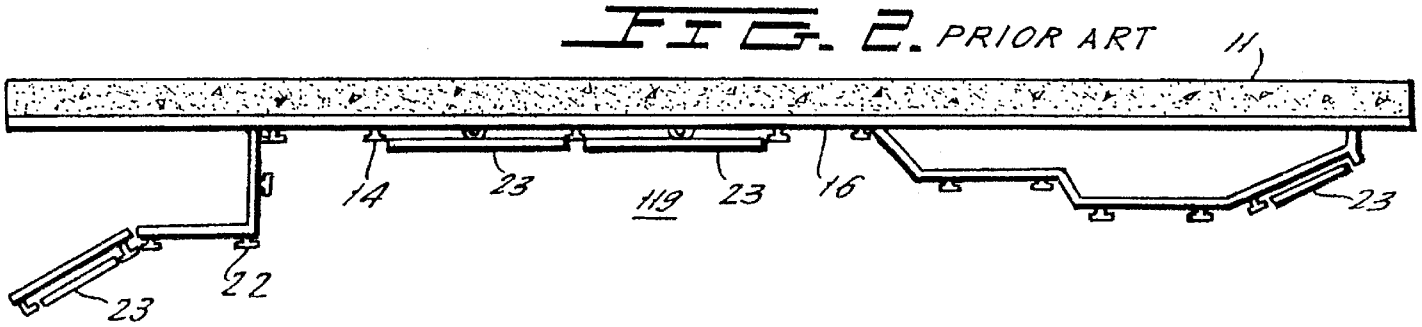
FIG. 2. PRIOR ART
FIG. 2 is a plan view, in schematic form, of a Prior Art wall system.
Figure 6:
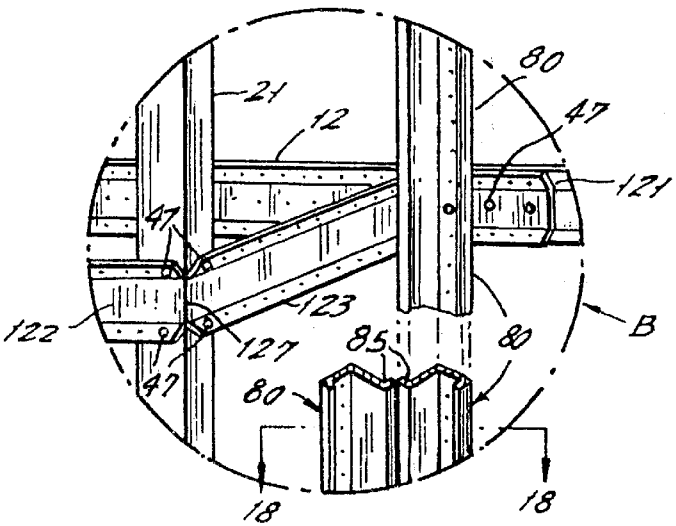
FIG. 6 is an enlargement of the area enclosed by circle B in FIG. 4.

Wall system 10 of FIG. 1 is constructed of a plurality of spaced horizontal main support channels 12 and a plurality of spaced main vertical members or standards 14 secured to the fronts of main channels 12. Top channel 16 caps the upper ends of standards 14 and bottom channel 18 caps the lower ends of standards 14. As will be explained hereinafter, these elements are connected to one another to form a main grid. This grid is used to removably support a decorative panel 23 and/or arm elements (not shown), as well as other decorative displays and/or structural elements.

Each main support channel 12 (FIGS. 9 and 9A) is an elongated element formed from galvanized steel sheets or the like to have a generally U-shaped cross-section consisting of arms 31, 32 that extend rearward from opposite ends of web 33. Ears 34, 35 extend outward from the rear ends of the respective arms 31, 32 and lie in a common plane. For reasons to be hereinafter seen, extending through web 33 are a plurality of locating apertures 36 that are equally spaced and are disposed in a longitudinally extending line located midway between the side edges of web 33. Each ear 34, 35 is provided with a series of clearance apertures 37. Fasteners (not shown) for securing main support channels 12 to wall 11 extend through as many of the clearance apertures 37 as is necessary.

Figure 5:
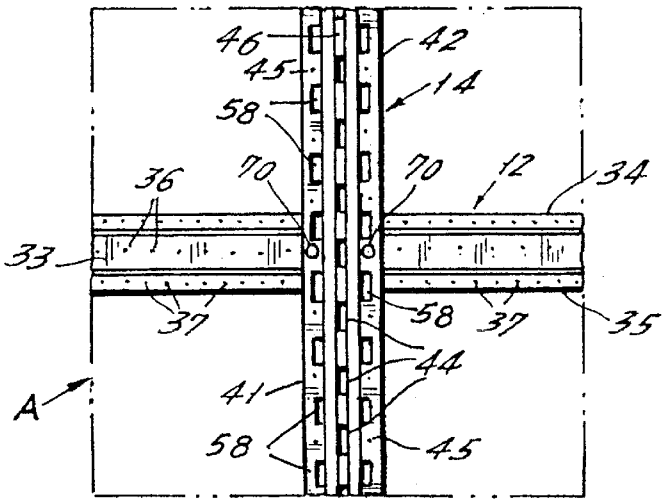
FIG. 5 is an enlargement of the area enclosed by rectangle A in FIG. 4.
Figure 15:
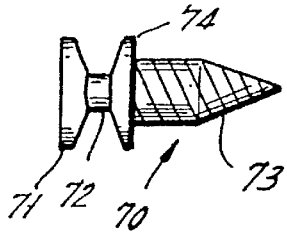
FIG. 15 is a side elevation of a fastener used for the mounting of a standard.
Figure 14:
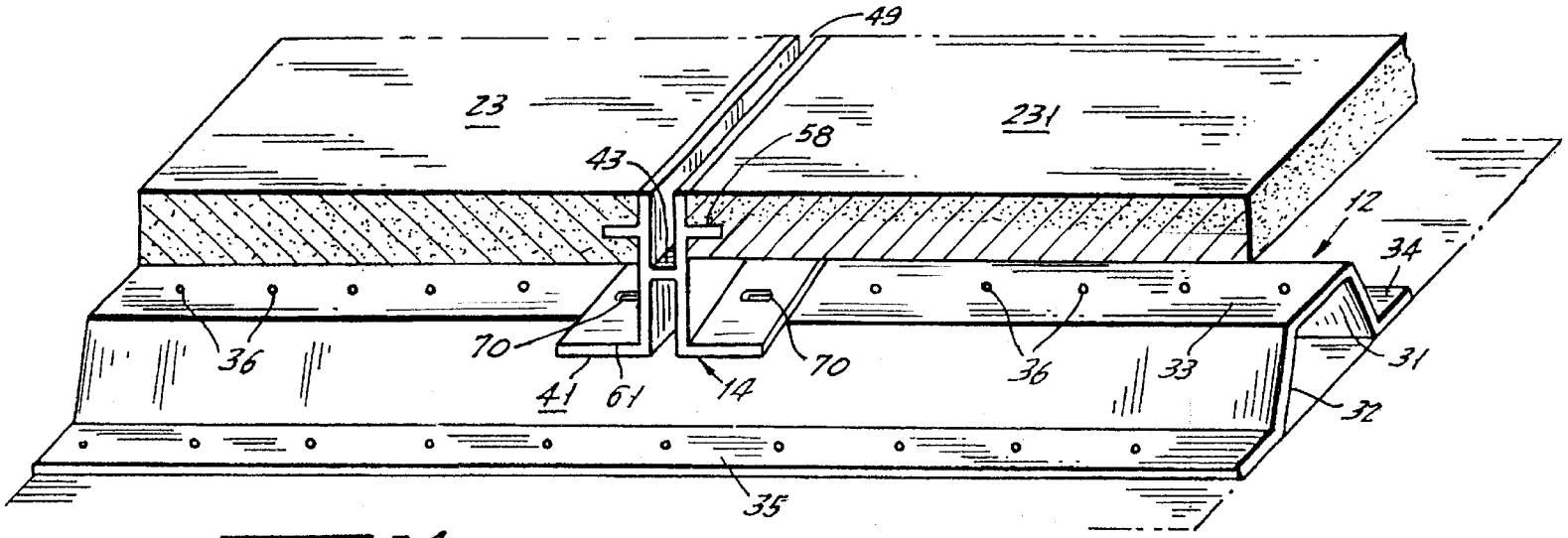
FIG. 14 is a fragmentary perspective illustrating panels mounted adjacent to one another with their front surfaces lying in a common plane.
Figure 10:
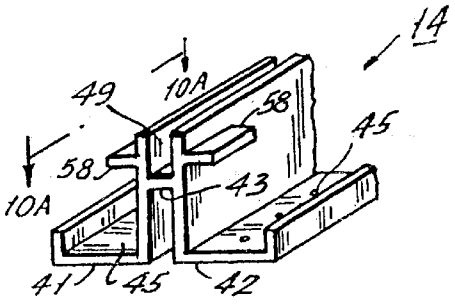
FIG. 10 is a fragmentary perspective of a standard.
Figure 10A:
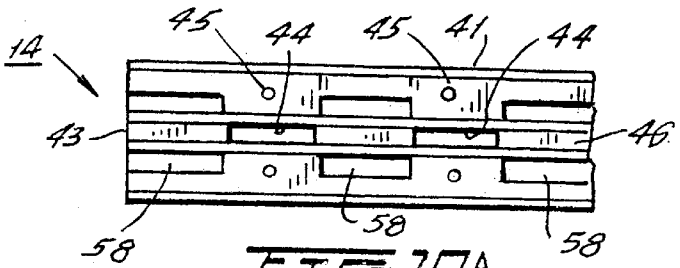
FIG. 10A is a front elevation of the standard of FIG. 10 looking in the direction of arrows 10A—10A.
Figure 11:
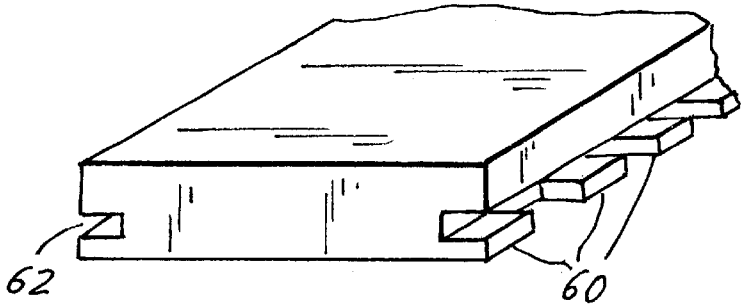
FIG. 11 is a fragmentary perspective of a panel support channel.
Figure 11A:
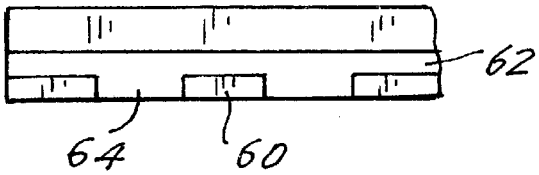
FIG. 11A is a front elevation of the panel support channel of FIG. 11 looking in the direction of arrows 11A—11A.
Figure 12:
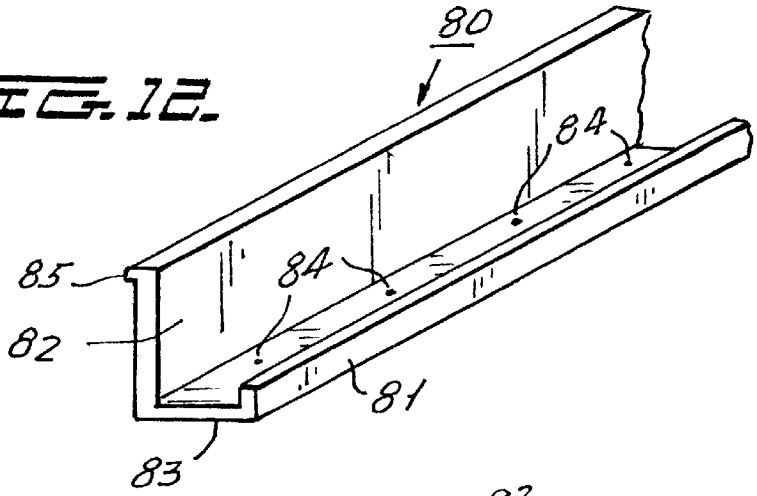
FIG. 12 is a fragmentary perspective of a panel divider strip of the Prior Art.
Figure 13:
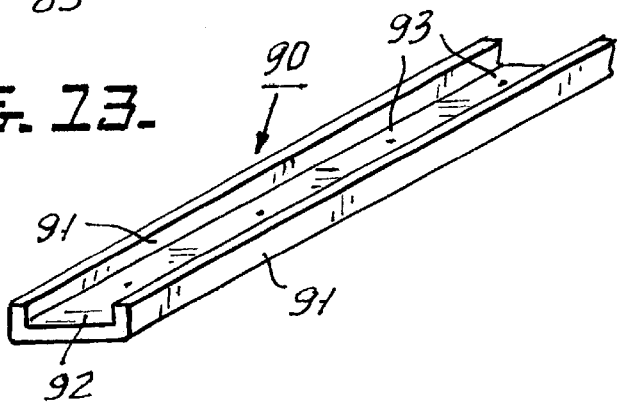
FIG. 13 is a fragmentary perspective of a panel sub-support of the Prior Art.

Standard 14 (FIGS. 10 and 10A) for mounting a panel 23 and for mounting forwardly projecting arms (not shown), is an elongated extruded member with two right angle channels 41, 42. Channels 41, 42 have orthogonal extensions of unequal length, with the longer extensions being adjacent each other. Channels 41, 42 are closely spaced by recessed rib 43 that extends across central slot 46, so that standard 14 is formed in the shape of an inverted T. Rib 43 is provided with equally spaced slots 44 for the mounting of forwardly extending support arms (not shown) of a type known to the art. The web or rear wall portion of each channel 41, 42 is provided with a plurality of equally spaced apertures 45 located along a line parallel to the longitudinal axis of standard 14. The spacing between apertures 45 in channel 41 and the adjacent apertures 45 in channel 42 is equal to the spacing between locating apertures 36. A line connecting two adjacent apertures 45, 45 in a horizontal direction is perpendicular to the longitudinal axis of standard 14. The arrangement of apertures permits standard 14 and main support channel 12 to be disposed at right angles when connected to one another by screw fasteners 70, 70 (FIGS. 5 and 15).

Channel 14 has a number of channel tabs 58 spaced apart at intervals along the length of channel 14. Channel tabs 58 are located on an outer surface of the longer extensions of channels 41,42, and are rectangular in plan view. A shorter side of channel tabs 58 extend in a direction parallel with the top of the inverted T. Channel tabs 58 are shaped to cooperate with a section of wall panel 23 to permit wall panel 23 to be inserted between, and supported by, two standards 14. Lateral edges of wall panel 23 have panel tabs 60 undercut by a slot 62 in a side surface which is slightly larger than a thickness of channel tabs 58. Notches 64 are formed in the rear surface of wall panel 23 near an edge with an undercut slot 62 so that slot 62 is accessible from the rear surface through notches 64. Notches 64 define panel tabs 60 on a corner of wall panel 23 common to the rear and side surfaces of wall panel 23. When wall panel 23 is inserted between two standards 14, panel tabs 60 on wall panel 23 and channel tabs 58 on standards 14 are interlaced, with panel tabs 60 fitting between the intervals of channel tabs 58, and channel tabs 58 fitting into notches 64. After insertion between standards 14, wall panel 23 is slid downward to interlock channel tabs 58 with panel tabs 60. Channel tabs 58 slide along the undercut slot 62 in the edge of wall panel 23 to be positioned behind panel tabs 60. Once channel tabs 58 are in a position adjoining panel tabs 60, wall panel 23 is interlocked with standards 14. The interlocking sets of channel tabs 58 and panel tabs 60 secure wall panel 23 and standards 14 in an arrangement in which wall panel 23 can be easily removed.

Figure 7A:
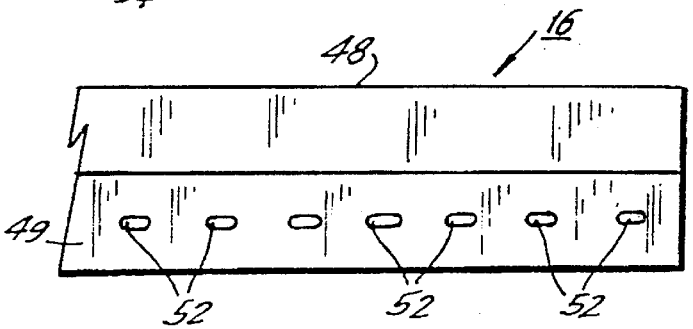
FIG. 7A is a front elevation of the top channel of FIG. 7 looking in the direction of arrows 7A—7A.
Figure 7:
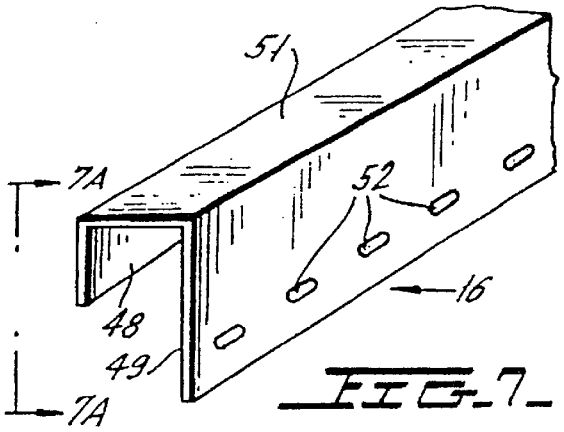
FIG. 7 is a fragmentary perspective of a top channel.

Top channel 16 (FIGS. 7 and 7A) is an elongated sheet formed member having relatively short front arm 48 and relatively long rear arm 49 that extend downward from opposite edges of top face 50. A plurality of horizontally elongated apertures 52 in arm 49 are disposed below a lower edge of arm 48 in a row that is parallel to the longitudinal axis of top channel 16. The center-to-center spacing between adjacent apertures 52 is equal to the spacing between adjacent locating apertures 36 in main support channel 12 so that two adjacent apertures 52 may be aligned with apertures 45, 45 in opposite rows of standard 14 for securement of top channel 16 to standard 14 by screws 47.

Bottom channel 18 (FIGS. 8 and 8A) is an extruded elongated channel having a front wall 51 and a rear wall 53 that extend upward from bottom wall 54. Spaced horizontally elongated apertures 56 in rear wall 53 are disposed in a longitudinal row located above a top edge of front wall 51. The center-to-center spacing between adjacent apertures 5,6 equals the spacing between adjacent locating apertures 36 in main support channel 12. Screws 47 extending through apertures 45 in opposite rows of standard 14 and through adjacent apertures 56 in bottom channel 18 secure the latter to standard 14 with rear wall 53 lying adjacent the rear of standard 14.

Panel 23 is dismounted from the main grid of standards 14 connected to support channels 12, by being moved upward until channel tabs 58 and notches 64 are aligned and a bottom edge of panel 23 clears front wall 51 of bottom channel 18. At this point, channel tabs 58 and panel tabs 60 are no longer interlocked. Panel 23 is then moved outward to disengage channel tabs 58 from slot 62 and panel tabs 60 through notches 64. Once panel 23 is moved outward to disengage channel tabs 58, panel 23 can be raised as far as permitted by top channel 16. The bottom edge of panel 23 clears front wall 51 of bottom channel 18 and the bottom of panel 23 is tilted until outward panel 23 is entirely free of bottom channel 18. Panel 23 is then free to move downward until its upper edge is below front wall 48 of top channel 16. Panel 23 is then free of the grid of standards 14, support channels 12, top channel 16 and bottom channel 18.

Figure 4:
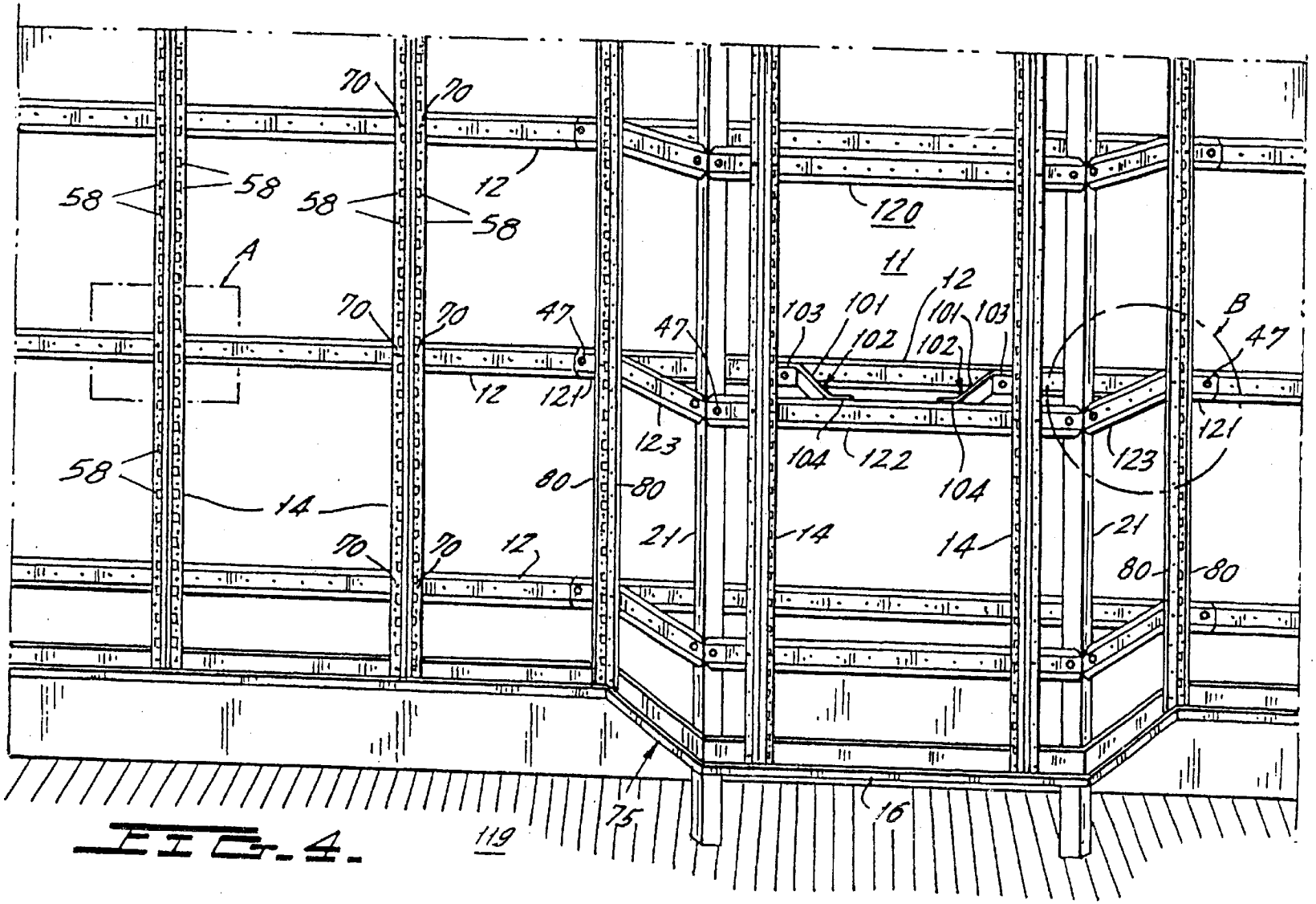
FIG. 4 is a fragmentary perspective showing an enlargement of an auxiliary grid section constructed in accordance with the teachings of the instant invention.
Figure 16:
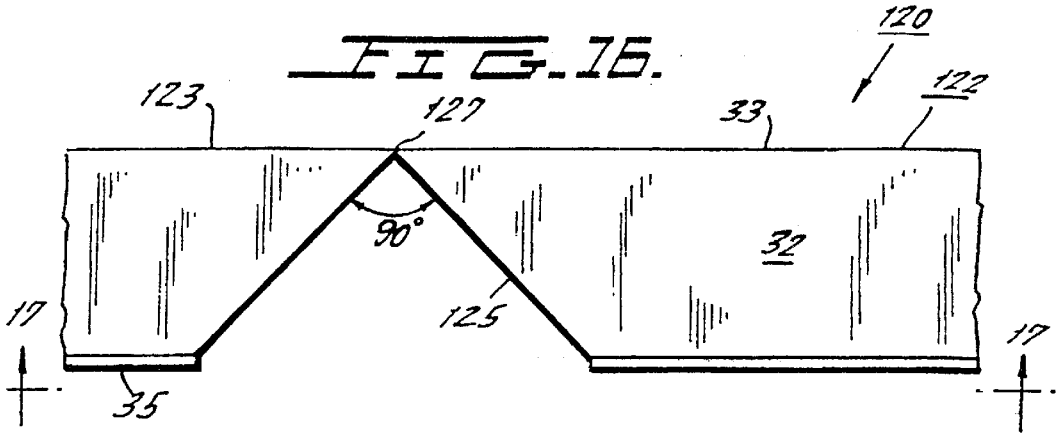
FIG. 16 is a side elevation of a main support channel that has been notched for bending.
Figure 17:
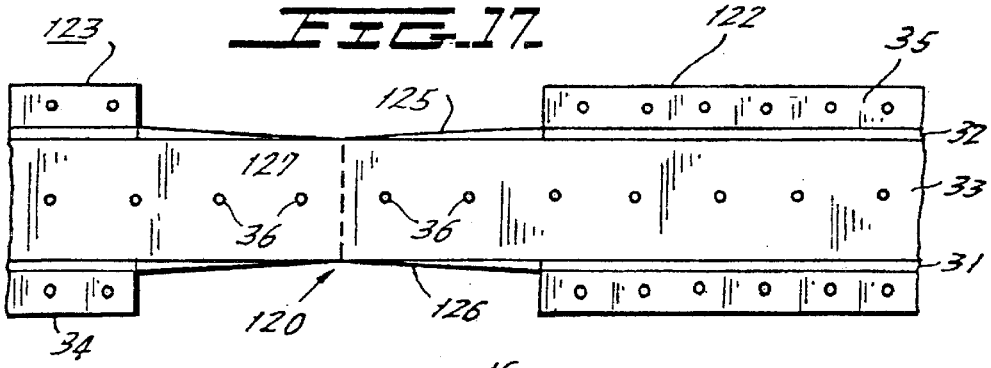
FIG. 17 is a rear elevation of the main support channel of FIG. 16 looking in the direction of arrows 17—17.

To construct an auxiliary wall section such as wing 75 of FIG. 4, an auxiliary grid is secured to the support channels 12 that-are mounted directly to wall 11. This auxiliary grid comprises a plurality of support channels 120 that are formed from a predetermined length of the same material with which support channels 12 are constructed. Each channel 120 includes a supporting section 121 at each end thereof, and central panel supporting section 122. Section 122 is parallel to wall 11 and offset forwardly therefrom by angled panel supporting sections 123. Section 123 connects opposite ends of central section 122 with end sections 121. Sections 121, 122 and 123 are connected at bend lines in web 33. Bending of channel 120 is done conveniently by forming V notches 125 (FIG. 16) at predetermined locations of arm 32 in channel 120 and by forming identical V notches 126 in arm 31 of channel 120. V-notches 125 and 126 are aligned, are of the same size and have an included angle of slightly more than 90°. The apices of V-notches 125, 126 locate bend line 127 which extends orthogonally to a line through locating apertures 36 and is midway between two adjacent locating apertures 36. By making V-notches 125, 126 slightly more than 90°, the included angle between central mounting section 122 and each of the outer mounting sections 123 may be as little as 90°.

As seen in FIG. 9, arms 31, 32 diverge slightly away from web 33. This permits supporting section 121 to be capped over main support channel 12 without appreciably increasing the thickness of the material that is mounted directly to wall 11. Naturally, to permit bending at line 127, those portions of ears 34, 35 that are aligned with V-notches 125, 126 must also be cut away.

For convenience, the angled cuts or lines defining V-notches 125, 126 may be made at a factory but the section of material bounded by V-notches 125, 126 is not removed until the element constituting member 120 is ready for installation in the field. During shipping, ears 34, 35 remain in tact to maintain the strength of member 120. The provision of V-notches 125, 126 permits the convenient formation of both interior and exterior corners, but interior corners may be formed by using only straight cuts in arms 31, 32 and ears 34, 35.

The weight of the auxiliary wall sections forming wing 75 and goods displayed thereon is taken up in large measure by having the lower ends of angle irons 21, 21 rest directly upon floor 119. The auxiliary wall sections of wing 75 stabilized by one or more cross-braces 101 constructed of V-notched material that is the same as that of straight support channels 12. Each cross-brace 101 has end sections 103, 104 that extend in opposite directions from central section 102 and are secured to support channel 12 and section 122, respectively.

By utilizing the techniques described in connection with construction of wing 75, auxiliary wall sections of different shapes, such as those illustrated in FIG. 1 as well as other shapes including a saw-tooth auxiliary wall section, may be constructed. It is noted that each of the vertical standards 14 is capable of receiving mating edges of panel 23.

Wall system 10 is constructed by marking a vertical center line and a horizontal level line on wall 11. The latter line is in the vicinity of a point that will be approximately halfway between top and bottom channels 16, 18. A first main support channel 12 is installed along the level line by attaching this first support channel 12 loosely to the front of wall 11 in a position such that the vertical center line is half-way between adjacent locating apertures 36 of channel 12. This is accomplished by utilizing fasteners (not shown) that are driven into wall 11 through clearance apertures 37 in arms 34, 35. Shims may be utilized to maintain ears 34, 35 of the first support channel 12 in a common vertical plane. When splicing main support channels 12 in axial alignment, a piece of main support channel 12 approximately one foot long should overlap equally the ends adjacent main support channels 12, 12 in which the spacing between adjacent locating apertures 36 is between one and two inches.

Standards 14 are attached to this first support channel 12 at appropriate locations therealong. This fastening is accomplished with screw fasteners 70. Before securing standards 14 to the first main support channel 12, standards 14 are cut to appropriate length. Additional horizontal runs of main support channels 12 are then slipped behind standards 14 and are secured thereto in spaced relationship to the first main support channel 12. The butt joints between axially aligned support channels 12 should be staggered. That is, the butt joints in a horizontal run of support channels 12 should be horizontally offset from the butt joints in alignment runs of channels 12. If wall 11 is provided with inside or outside corners, each run of main support channels 12 should have appropriately located V-notches 125, 126.

Thereafter, the first main support channel 12 is fixedly secured to wall 11 by fasteners (not shown) that are driven through clearance apertures 37. After the plumb condition of standards 14 is checked, the other main support channels 12 are shimmed and secured to wall 11.

Thereafter, appropriate elements are secured to the main grid for one or more auxiliary wall sections, such as wing 75 of FIG. 4. Panels 23 are then mounted as previously described in connection with channel tabs 58, panel tabs 60 and notches 64. Hooks (not shown) are engaged in selected slots 44 of standards 14. If desired, panels 235 may be installed below the section of bottom channel 18, especially at auxiliary wall sections such as wing 75.

It should be appreciated by those skilled in the art that the channels and main support members described may, for the most part, be constructed of metal or plastic, depending upon strength and cost considerations.

While the wall system described here is composed of channels and standard which are orthogonal to each other, and arranged in a grid with horizontal channels and vertical standards, it should be clear that the invention is not limited to this format. For example, the channels can conveniently be inclined on the attaching wall so that they are not necessarily horizontal, and need not be parallel to accomplish the invention. The standards likewise can be inclined away from the vertical. While the standards must be substantially parallel to realize the invention, they may be of differing lengths to support odd shapes. The undercut tabs in the panel can also be replaced by structural equivalents, such as inserted tabs, which can be pegs, screws or the like.

In addition, the present invention is not limited to use as a wall system, but rather can serve as a floor or ceiling system, and can be used indoors or outside.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A surface construction system, comprising:

at least one support member attachable to a support surface;

a plurality of parallel panel supports laterally affixed to said at least one support member;

said supports having a lengthwise bar portion extending in a direction away from said support surface;

said bar portion having spaced retaining tabs;

a panel mountable between adjacent ones of said supports;

said panel having spaced panel tabs on lateral edges defines spaces therebetween;

said spaces between said panel tabs are aligned with said retaining tabs when said panel is to be mounted; and said panel tabs slidable to cooperate with said retaining tabs to removably secure said panel to said supports.

2. A surface construction system according to claim 1, wherein:

said at least one support member includes a plurality of support members;

said support members having a web portion connected to arm extensions on lateral sides and ear portions connected to said arm extensions;

said ear portions fixable to said support surface; and said panel supports fixable to said web portion.

3. A surface construction system according to claim 2, wherein:

said at least one support member has a first set of openings extending along a length of said web portion;

said panel supports each have a second set of openings along a length of said panel supports;

said second set of openings includes pairs of locating apertures spaced orthogonal to said length of said panel supports, each of said pairs spaced along said length of said panel supports;

said at least one support member and said panel supports are oriented to align a plurality of openings from said first set of openings with a pair of locating apertures on said panel supports; and said at least one support member and said panel supports are detachably attachable and securely fixed with attaching members inserted in said aligned openings.

4. A surface construction system according to claim 2, wherein:

said at least one support member is U-shaped; and said arm extensions diverge in a direction toward said support surface.

5. A surface construction system according to claim 1, wherein said at least one support member and said supports extend in a horizontal and a vertical direction, respectively, to form a main grid.

6. A surface construction system according to claim 5, further including:

an auxiliary grid angularly disposed with respect to said main grid;

said auxiliary grid including a plurality of vertically spaced horizontal auxiliary support members and another plurality of vertical auxiliary panel supports secured to said auxiliary support members;

said at least one support member and said auxiliary support members being of like cross-section;

each of said auxiliary support members including a mounting section and a supporting section formed integrally with said mounting section and connected thereto in end to end relationship at a transverse bend line in said auxiliary support member;

said mounting section telescoping over a main support member and being secured directly thereto;

said supporting section and said mounting section having a predetermined angle therebetween; and said another plurality of vertical panel supports being secured to said supporting section.

7. A surface construction system according to claim 6, wherein:

each of said auxiliary support members also includes another mounting section at one end thereof and said mounting section at another end thereof; and said another mounting section also telescoping over a main support member and being secured directly thereto.

8. A surface construction system according to claim 6, wherein:

for each of said auxiliary support members, prior to bending thereof at said bend line, having said mounting and supporting sections thereof in axial alignment, with diverging arms of said auxiliary support member having a notch therein; and said bend line extending between the apices of said notches.

9. A surface construction system according to claim 8, wherein:

prior to bending of said auxiliary support members each of said notches defines an included angle of approximately 90°.

10. A surface construction system according to claim 1, wherein:

said bar portion includes a plurality of adjacent walls defining slots therebetween; and spaced bracket mounting members span said slots.

11. A surface construction system according to claim 1, further including:

first and second end brackets;

said first and second end brackets attachable to said plurality of supports at opposing ends thereof, respectively; and extensions on said first and second end brackets overlap a portion of an exposed surface of said panel.

12. A surface construction system according to claim 11, wherein at least one of said first and second end brackets limits a distance over which said panel can be slid.

13. A method for mounting a panel on a panel mounting system, comprising:

attaching at least one support member to a support surface;

attaching a plurality of panel supports having a plurality of tabs to at least one support member;

inserting a panel between adjacent panel supports, said panel having a plurality of panel tabs and a plurality of tab keys that are alignable with said plurality of tabs;

aligning said plurality of tab keys with said plurality of tabs;

engaging said plurality of tab keys with said plurality of tabs;

sliding said panel along said panel supports; and engaging said plurality of tabs with said plurality of panel tabs.

14. A method for mounting a panel according to claim 13, further including attaching first and second end brackets to said panel supports at opposing ends thereof, respectively.

15. The method according to claim 14, including dismounting a mounted panel from a panel mounting system, comprising:

sliding said mounted panel along said panel supports in a first direction until an edge of said mounted panel clears an edge of at least one of said first and second end brackets;

sliding said mounted panel further in said first direction until said plurality of tabs and said plurality of panel tabs are disengaged;

moving a cleared edge of said mounted panel away from said panel supports until an end of said mounted panel clears said at least one of said first and second end brackets; and sliding said mounted panel in a second direction opposite that of said first direction, until another edge of said mounted panel clears an edge of at least another of said first and second end brackets.

16. A panel mounting configuration, comprising:

a plurality of parallel support rails affixed to a support surface;

said plurality of rails each includes a base section and at least one extension extending from said base section;

a plurality of spaced rib tabs extending laterally from said at least one extension, generally parallel to said base section;

a panel having a plurality of panel tabs accessible from a rear surface of said panel; and said plurality of rib tabs being engageable with cooperating ones of said plurality of panel tabs by said panel tabs being insertable through spaces between said rib tabs and thereafter slidable behind said rib tabs.

17. A panel mounting configuration according to claim 16, further including:

a first and second end channel;

said first and second end channels affixable to said base section at opposing ends of said panel, respectively; and said first and second end channels effective to limit slide movement when said panel is slid.

* * * * *

UNITED STATES PATENT AND TRADEMARK OFFICE

CERTIFICATE OF CORRECTION

PATENT NO. : 6,430,883 B1
DATED : August 13, 2002
INVENTOR(S) : Paz et al.

It is certified that error appears in the above-identified patent and that said Letters Patent is hereby corrected as shown below:

Title page,
Item [75], Inventors, should read -- Felix Paz, Farmingdale; Edward Owsinski, Kings Park, both of NY (US) --

Signed and Sealed this

Twenty-seventh Day of January, 2004

JON W. DUDAS
*Acting Director of the United States Patent and Trademark Office*